US010858963B2

(12) United States Patent
Nielsen et al.

(10) Patent No.: US 10,858,963 B2
(45) Date of Patent: Dec. 8, 2020

(54) ROCKER ARM ASSEMBLY FOR ENGINE BRAKING

(71) Applicant: Eaton Intelligent Power Limited, Dublin (IE)

(72) Inventors: Douglas J. Nielsen, Marshall, MI (US); James E. McCarthy, Jr., Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/597,319

(22) Filed: Oct. 9, 2019

(65) Prior Publication Data

US 2020/0040777 A1 Feb. 6, 2020

Related U.S. Application Data

(63) Continuation of application No. 15/654,877, filed on Jul. 20, 2017, now Pat. No. 10,465,567, which is a continuation of application No. PCT/US2016/013992, filed on Jan. 20, 2016.

(60) Provisional application No. 62/106,203, filed on Jan. 21, 2015, provisional application No. 62/280,652, filed on Jan. 19, 2016.

(51) Int. Cl.

| | |
|---|---|
| ***F01L 1/18*** | (2006.01) |
| ***F01L 1/24*** | (2006.01) |
| ***F01L 1/26*** | (2006.01) |
| ***F01L 13/06*** | (2006.01) |
| ***F01L 13/00*** | (2006.01) |

(52) U.S. Cl.

CPC ..... *F01L 1/2405* (2013.01); *F01L 1/181* (2013.01); *F01L 1/26* (2013.01); *F01L 13/0036* (2013.01); *F01L 13/065* (2013.01); *F01L 1/2411* (2013.01); *F01L 2305/00* (2020.05)

(58) Field of Classification Search

CPC . F01L 1/2405; F01L 1/181; F01L 1/26; F01L 1/2411; F01L 13/0036; F01L 13/065; F01L 2105/00

See application file for complete search history.

(56) References Cited

U.S. PATENT DOCUMENTS

| | | | |
|---|---|---|---|
| 5,353,756 | A | 10/1994 | Murata et al. |
| 5,495,838 | A | 3/1996 | Johnson, Jr. |
| 5,806,477 | A | 9/1998 | Regueiro |

(Continued)

OTHER PUBLICATIONS

Japanese Office Action for JP Application No. 2017-538366 dated Sep. 17, 2019 with English translation.

(Continued)

*Primary Examiner* — Zelalem Eshete

(74) *Attorney, Agent, or Firm* — RMCK Law Group PLC

(57) ABSTRACT

An exhaust valve rocker arm assembly selectively opening first and second exhaust valves includes an exhaust rocker arm, an engagement capsule, a valve bridge operably associated with the rocker arm and including a main body, and a hydraulic actuator assembly disposed at least partially within an aperture formed within the main body. The hydraulic actuator assembly includes a first piston body and a second piston body disposed at least partially within the aperture formed in the main body. The exhaust rocker arm is configured to engage the valve bridge main body to engage the first exhaust valve, and the engagement capsule is configured to engage the hydraulic actuator to engage the second exhaust valve.

16 Claims, 7 Drawing Sheets

(56) References Cited

U.S. PATENT DOCUMENTS

| | | | |
|---|---|---|---|
| 5,975,251 | A | 11/1999 | McCarthy |
| 5,992,376 | A | 11/1999 | Okada et al. |
| 6,253,730 | B1 | 7/2001 | Gustafson |
| 8,800,520 | B2 | 8/2014 | D'Amore |
| 9,016,249 | B2 | 4/2015 | Roberts et al. |
| 2005/0211206 | A1 | 9/2005 | Ruggiero et al. |
| 2008/0072857 | A1 | 3/2008 | Sailer et al. |
| 2010/0319657 | A1 | 12/2010 | Dodi et al. |
| 2011/0067661 | A1 | 3/2011 | Schwoerer |
| 2011/0079195 | A1 | 4/2011 | Dilly |
| 2011/0220062 | A1 | 9/2011 | Sailer et al. |
| 2012/0186546 | A1 | 7/2012 | Cecur et al. |
| 2014/0130774 | A1 | 5/2014 | Forestier et al. |
| 2015/0144096 | A1 | 5/2015 | Meneely et al. |
| 2015/0159520 | A1 | 6/2015 | Cecur |
| 2015/0354418 | A1 | 12/2015 | Jo et al. |
| 2017/0016358 | A1 | 1/2017 | Yoon |
| 2017/0175597 | A1 | 6/2017 | Cecur |
| 2017/0321576 | A1 | 11/2017 | Nielsen |

OTHER PUBLICATIONS

International Search Report and Written Opinion for International Application No. PCT/US2017/026541 dated Jul. 20, 2017, 17 pages.

ROCKER ARM ASSEMBLY FOR ENGINE BRAKING

CROSS-REFERENCE TO RELATED APPLICATIONS

This application is a continuation of U.S. patent application Ser. No. 15/654,877, filed Jul. 20, 2018, which is a continuation of International Application No. PCT/US2016/013992 filed on Jan. 20, 2016, which claims the benefit of U.S. Patent Application No. 62/106,203 filed on Jan. 21, 2015 and U.S. Patent Application No. 62/280,652 filed on Jan. 19, 2016. The disclosures of the above applications are incorporated herein by reference.

FIELD

The present disclosure relates generally to a rocker arm assembly for use in a valve train assembly and, more particularly, to a rocker arm assembly having an engine braking bridge.

BACKGROUND

Compression engine brakes can be used as auxiliary brakes in addition to wheel brakes, for example, on relatively large vehicles powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one aspect of the present disclosure an exhaust valve rocker arm assembly selectively opening first and second exhaust valves is provided. In one example, the exhaust valve rocker arm assembly includes an exhaust rocker arm, an engagement capsule, a valve bridge operably associated with the rocker arm and including a main body, and a hydraulic actuator assembly disposed at least partially within an aperture formed within the main body. The hydraulic actuator assembly includes a first piston body and a second piston body disposed at least partially within the aperture formed in the main body. The exhaust rocker arm is configured to engage the valve bridge main body to engage the first exhaust valve, and the engagement capsule is configured to engage the hydraulic actuator to engage the second exhaust valve.

In addition to the foregoing, the exhaust valve rocker arm assembly may include one or more of the following features: wherein the hydraulic actuator assembly further includes an outer housing, the first piston body and the second piston body at least partially disposed within the outer housing and defining a central chamber therebetween configured to receive a fluid; wherein the hydraulic actuator assembly further comprises a biasing mechanism disposed between the first piston body and the second piston body; and an engine brake rocker arm, wherein the engagement capsule is coupled to the engine brake rocker arm.

In addition to the foregoing, the exhaust valve rocker arm assembly may include one or more of the following features: wherein the engagement capsule is fluidly coupled to a pressurized oil supply; wherein the engagement capsule is fluidly coupled to an oil supply channel formed in the second piston body; wherein the second piston body includes a check ball assembly seat receiving a check ball assembly; wherein the check ball assembly comprises a retainer, a check ball, and a biasing mechanism; and a hydraulic lash adjuster assembly coupled between the exhaust rocker arm and the valve bridge.

In another aspect of the present disclosure, a valve train assembly is provided. In one example, the valve train assembly includes a first exhaust valve, a second exhaust valve, and an exhaust valve rocker arm assembly selectively opening the first and second exhaust valves. The exhaust valve rocker arm assembly includes an exhaust rocker arm, an engagement capsule, a valve bridge operably associated with the rocker arm and including a main body, and a hydraulic actuator assembly disposed at least partially within an aperture formed within the main body. The hydraulic actuator assembly includes a first piston body and a second piston body disposed at least partially within the aperture formed in the main body. The exhaust rocker arm is configured to engage the valve bridge main body to engage the first exhaust valve, and the engagement capsule is configured to engage the hydraulic actuator to engage the second exhaust valve.

In addition to the foregoing, the valve train assembly may include one or more of the following features: wherein the hydraulic actuator assembly further includes an outer housing, the first piston body and the second piston body at least partially disposed within the outer housing and defining a central chamber therebetween configured to receive a fluid; wherein the hydraulic actuator assembly further comprises a biasing mechanism disposed between the first piston body and the second piston body; an engine brake rocker arm, wherein the engagement capsule is coupled to the engine brake rocker arm; and wherein the engagement capsule is fluidly coupled to a pressurized oil supply.

In addition to the foregoing, the valve train assembly may include one or more of the following features: wherein the engagement capsule is fluidly coupled to an oil supply channel formed in the second piston body; wherein the second piston body includes a check ball assembly seat receiving a check ball assembly; wherein the check ball assembly comprises a retainer, a check ball, and a biasing mechanism; and a hydraulic lash adjuster assembly coupled between the exhaust rocker arm and the valve bridge.

In another aspect of the present disclosure, an exhaust valve rocker arm assembly selectively opening first and second exhaust valves is provided. In one example, the assembly includes an exhaust rocker arm, and a valve bridge operably associated with the rocker arm and including a main body and a movable lever assembly integrated into the main body, the main body configured to engage the first exhaust valve, and the lever assembly configured to engage the second exhaust valve. A hydraulic lash adjuster (HLA) assembly is coupled between the exhaust rocker arm and the valve bridge, and the lever assembly is configured to pass a portion of a valve actuation force back to the HLA assembly to facilitate preventing unintended extension of the HLA assembly during a braking event.

BRIEF DESCRIPTION OF THE DRAWINGS

The present disclosure will become more fully understood from the detailed description and the accompanying drawings, wherein.

DETAILED DESCRIPTION

Figure 1:
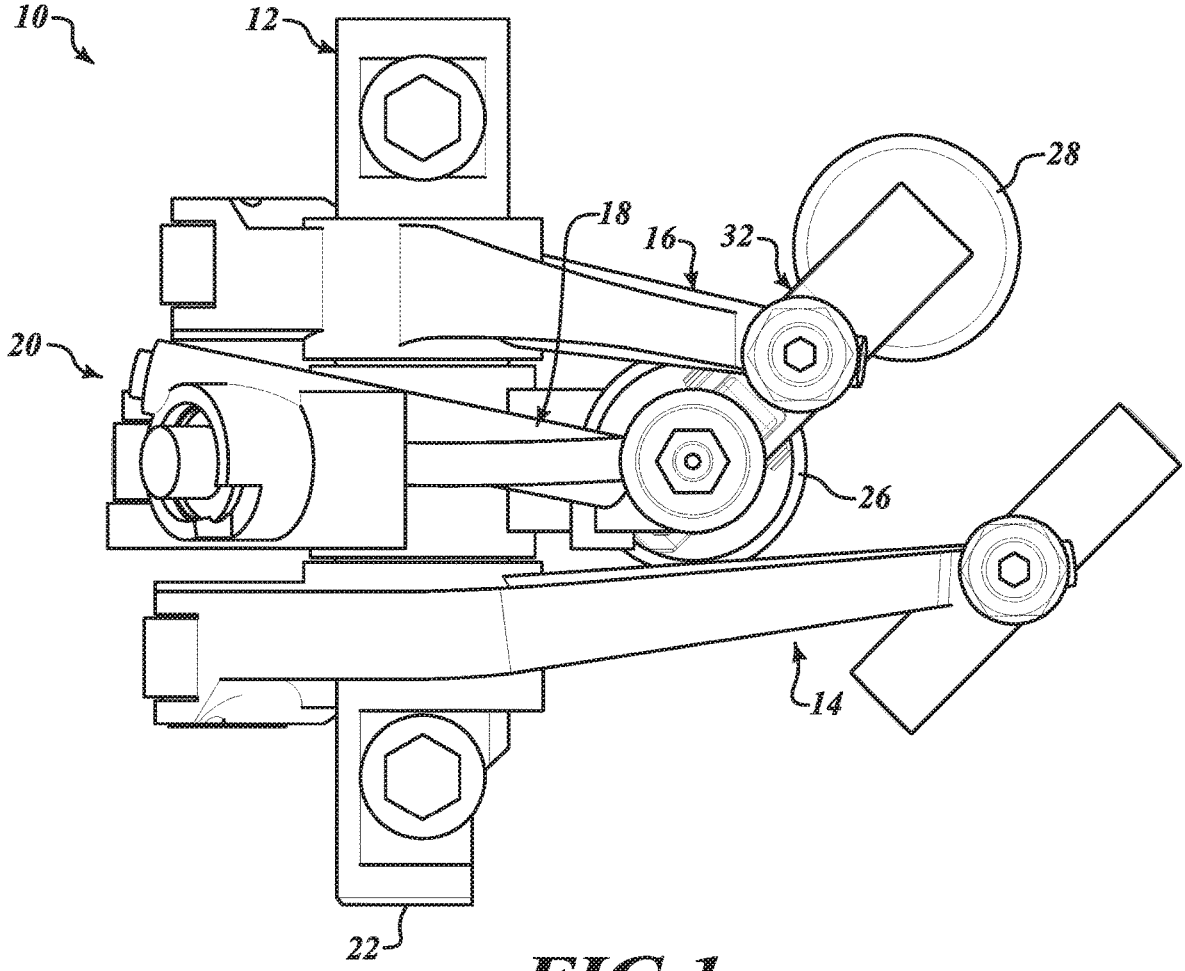
FIG. 1 is a plan view of a valve train assembly incorporating a rocker arm assembly that includes an intake rocker arm assembly, an exhaust rocker arm assembly, and an engine brake rocker arm assembly constructed in accordance to one example of the present disclosure.
Figure 2:
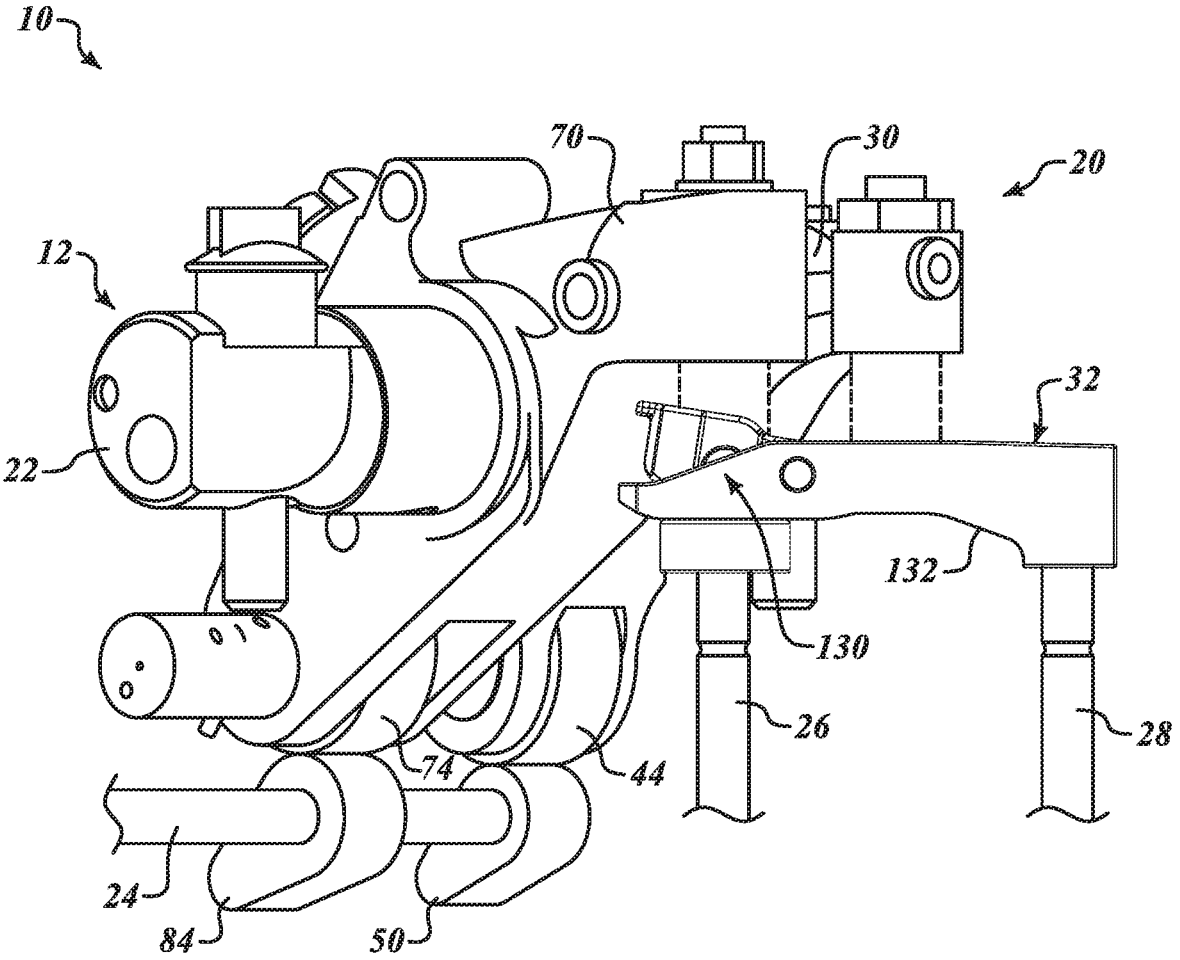
FIG. 2 is a perspective view of the valve train assembly shown in FIG. 1 without the intake rocker arm assembly.

With initial reference to FIGS. 1 and 2, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking. The partial valve train assembly 10 is supported in a valve train carrier 12 and can include three rocker arms per cylinder.

Specifically, each cylinder includes an intake valve rocker arm assembly 14, an exhaust valve rocker arm assembly 16, and an engine brake rocker arm assembly 18. The exhaust valve rocker arm assembly 16 and the engine brake rocker arm assembly 18 cooperate to control opening of the exhaust valves and are collectively referred to as a dual rocker arm assembly 20 (FIG. 2). The intake valve rocker arm assembly 14 is configured to control motion of the intake valves, the exhaust valve rocker arm assembly 16 is configured to control exhaust valve motion in a drive mode, and the engine brake rocker arm assembly 18 is configured to act on one of the two exhaust valves in an engine brake mode, as will be described herein.

A rocker shaft 22 is received by the valve train carrier 12 and supports rotation of the exhaust valve rocker arm assembly 16 and the engine brake rocker arm assembly 18. As described herein in more detail, the rocker shaft 22 can communicate oil to the assemblies 16, 18 during operation. A cam shaft 24 includes lift profiles or cam lobes configured to rotate assemblies 16, 18 to activate first and second exhaust valves 26 and 28, as is described herein in more detail.

Figure 3:
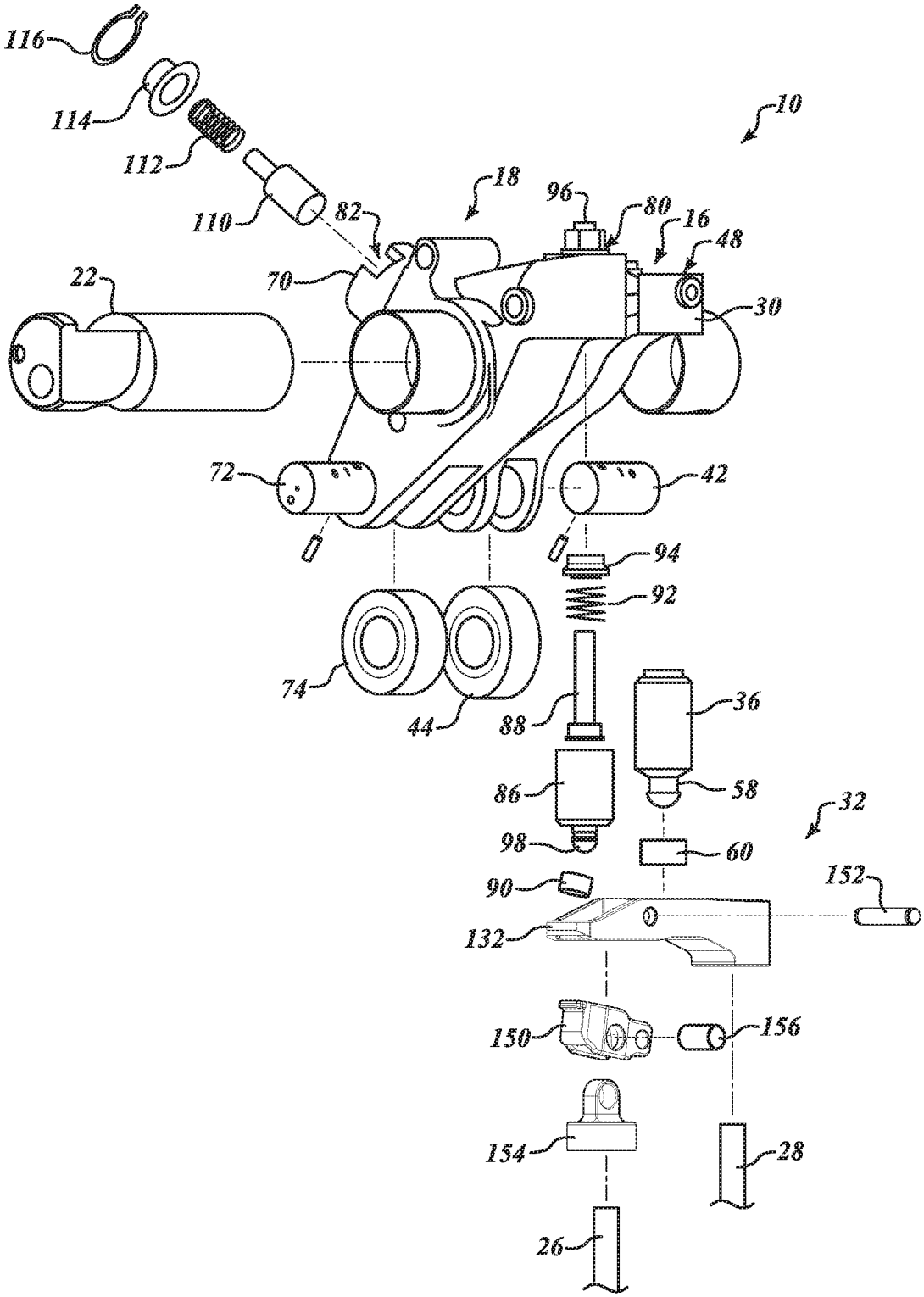
FIG. 3 is an exploded view of the exhaust valve rocker arm assembly and the engine brake rocker arm assembly of FIG. 1.

With further reference now to FIGS. 2 and 3, exhaust valve rocker arm assembly 16 will be further described. The exhaust valve rocker arm assembly 16 can generally include an exhaust rocker arm 30, a valve bridge assembly 32, and a hydraulic lash adjuster (HLA) assembly 36.

The exhaust rocker arm 30 includes a body 40, an axle 42, and a roller 44. Body 40 can receive the rocker shaft 22 and defines a bore 48 configured to at least partially receive the HLA assembly 36. The axle 42 can be coupled to the body 40 and can receive the roller 44, which is configured to be engaged by an exhaust lift profile or cam lobe 50 (FIG. 2) of the cam shaft 24. As such, when roller 44 is engaged by the exhaust lift profile 50, the exhaust rocker arm 30 is rotated downward, causing downward movement of the valve bridge assembly 32, which engages the first and second exhaust valve 26 and 28 (FIG. 2) associated with a cylinder of an engine (not shown).

The HLA assembly 36 is configured to take up any lash between the HLA assembly 36 and the valve bridge assembly 32. With additional reference to FIGS. 8 and 9, in one exemplary implementation, the HLA assembly 36 can comprise a plunger assembly 52 including a leak down plunger or first plunger body 54 and a ball plunger or second plunger body 56. The plunger assembly 52 is received by bore 48 defined in rocker arm 30, and can have a first closed end defining a spigot 58, which is received in a socket 60 that acts against the valve bridge assembly 32. The second plunger body 56 has an opening that defines a valve seat 62, and a check ball assembly 64 can be positioned between the first and second plunger bodies 54, 56.

Figure 8:
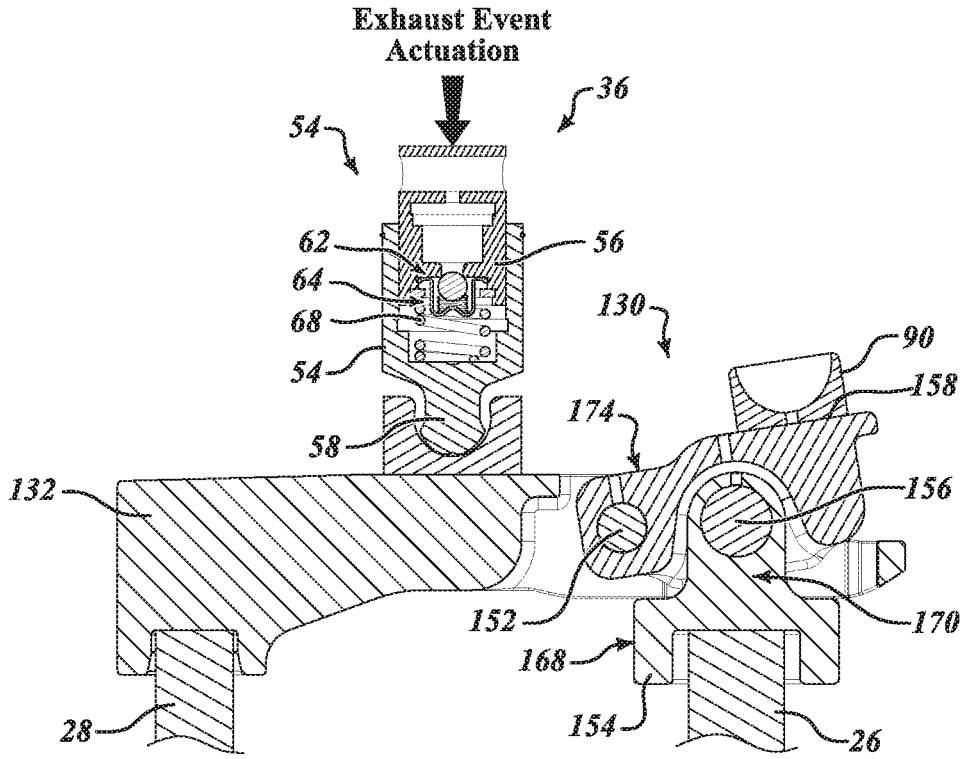
FIG. 8 is a cross-sectional view of the rocker arm assembly shown in FIG. 5 taken along line 8-8 and during a normal exhaust event actuation.
Figure 9:
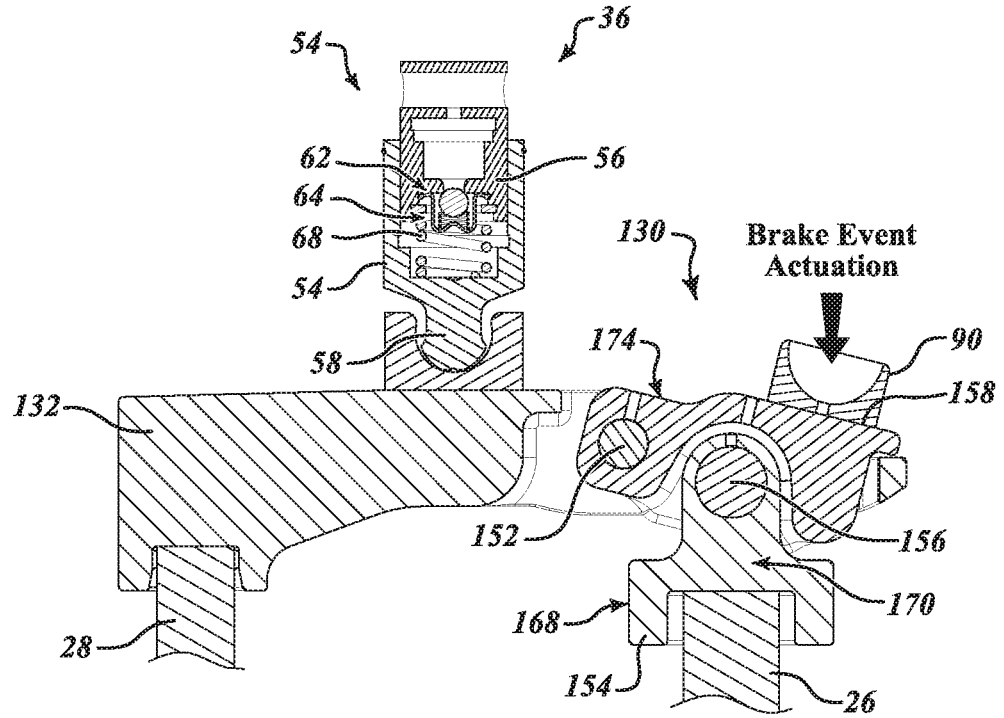
FIG. 9 is a cross-sectional view of the rocker arm assembly shown in FIG. 5 taken along line 8-8 and during a brake event actuation.

The check ball assembly 64 can be configured to hold oil within a chamber 66 between the first and second plunger bodies 54, 56. A biasing mechanism 68 (e.g., a spring) biases second plunger body 56 upward (as shown in FIGS. 8 and 9) to expand the first plunger body 54 to take up any lash. As second plunger body 56 is biased upward, oil is drawn through check ball assembly 64 and into the chamber 66 between plunger bodies 54, 56. Accordingly, oil can be supplied from rocker shaft 22 through a channel (not shown) to the chamber within second plunger 56, and downward pressure can cause downward movement of the first plunger body 54 due to the oil in the chamber 66. However, HLA assembly 36 may have any other suitable configuration that enables assembly 36 to take up lash between the assembly and the valve bridge assembly 32.

Figure 4:
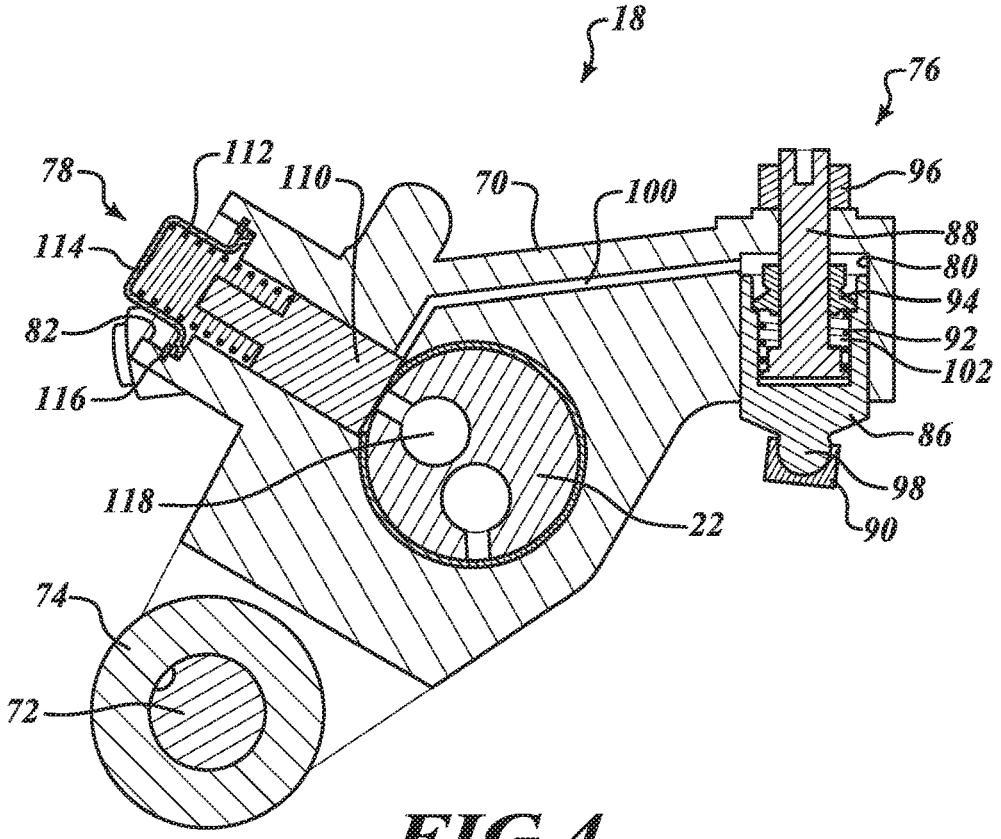
FIG. 4 is a cross-sectional view of the engine brake rocker arm assembly shown in FIG. 3 and taken along line 4-4.

With further reference now to FIGS. 2-4, engine brake rocker arm assembly 18 will be further described. The engine brake rocker arm assembly 18 can generally include an engine brake rocker arm 70, an axle 72, a roller 74, an actuator or piston assembly 76, and a check valve assembly 78.

Engine brake rocker arm 70 can receive the rocker shaft 22 and can define a first bore 80 and a second bore 82. The first bore 80 can be configured to at least partially receive the piston assembly 76, and the second bore 82 can be configured to at least partially receive the check valve assembly 78. The axle 72 can be coupled to the rocker arm 70 and can receive the roller 74, which is configured to be engaged by a brake lift profile or cam lobe 84 (FIG. 2) of the cam shaft 24. As such, when the roller 74 is engaged by the cam lobe 84, the brake rocker arm 70 is rotated downward, causing downward movement of the piston assembly 76.

As shown in FIGS. 3 and 4, the actuator or piston assembly 76 can include a first actuator or piston body 86, a second actuator or piston body 88, a socket 90, a biasing mechanism 92, a stopper 94, and a nut 96. The piston assembly 76 can be received by the first bore 80 of the rocker arm 70. The first piston body 86 can include a first closed end that defines a spigot 98, which is received in socket 90 that acts against the valve bridge assembly 32. The second piston body 88 can be secured to rocker arm 70 by nut 96, and stopper 94 can be secured to the second piston body 88. The second piston body 88 and the nut 96 can act as a fine adjustment screw to set the initial position of piston assembly 76.

The biasing mechanism 92 (e.g., a spring) is configured to draw or retract the first piston body 86 upward into the bore 80 to a retracted position. The stopper 94 can be configured to limit upward movement of the first piston body 86. Pressurized oil is selectively supplied through a channel 100 (FIG. 4) to a chamber 102 of the first piston body 86 to move the piston body 86 downward and outward from the bore 80 to an extended position. When the oil supply to channel 100 is suspended, the first piston body 86 returns to the retracted position by the biasing mechanism 92.

The check valve assembly 78 is at least partially disposed in the second bore 82 and can include a spool or check valve 110, a biasing mechanism 112, a cover 114, and a clip 116. The check valve assembly 78 is configured to selectively supply oil from a channel 118 (FIG. 4) in the rocker shaft 22 to the channel 100. The check valve 110 can be biased into a closed position by the biasing mechanism 112 such that oil is not supplied to channel 100. When the oil pressure in channel 118 is sufficient to open the check valve 110, the oil is supplied via the channel 100 to actuate the piston assembly 76 into the extended position. Clip 116 can nest in a radial groove provided in the second bore 82 to retain the check valve assembly 78 therein.

Many known engines with hydraulic valve lash adjustment have a single rocker arm that actuates two valves through a valve bridge across those valves. The engine brake bypasses the bridge and pushes on one of the valves, which cocks or angles the valve bridge, to open a single valve and blow down the cylinder. However, due to the cocked valve bridge, the HLA can react by extending to take up the lash created. This may be undesirable because, after the brake event, the extended HLA assembly can then hold the exhaust valves open with certain loss of compression and possibly piston-to-valve contact.

To overcome this potentially undesirable event, assembly 10 includes valve bridge assembly 32 having a movable lever assembly 130 integrated therein. The lever assembly 130 can pass some of the valve actuation force back to the HLA assembly 36 (via bridge 32), thereby preventing unintended extension of the HLA assembly during the braking event. Thus, lever assembly 130 allows the valve 26 to open during the engine braking operation without allowing downward motion of the valve bridge assembly 32. Moreover, lever assembly 130 significantly reduces the actuation force required for the braking event compared to known systems.

Figure 6:
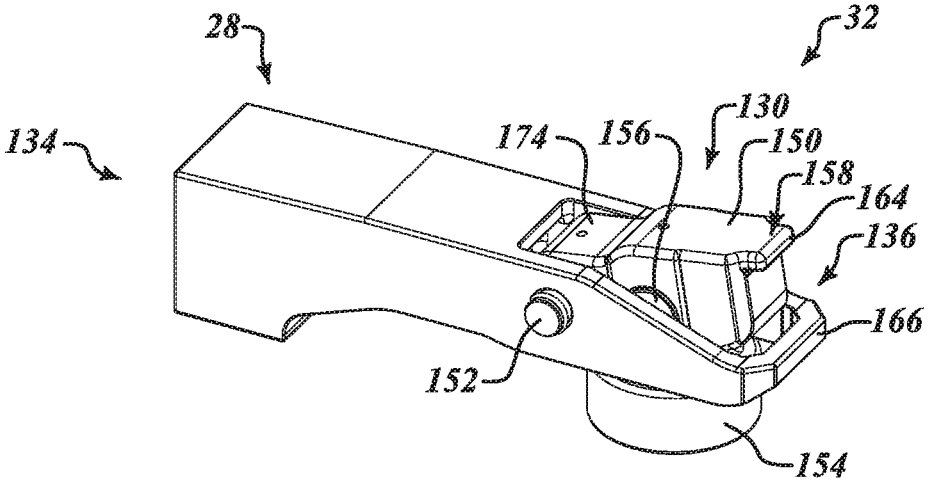
FIG. 6 is a perspective view of a valve bridge assembly of the exhaust valve rocker arm assembly shown in FIG. 1, constructed in accordance to one example of the present disclosure.
Figure 7:
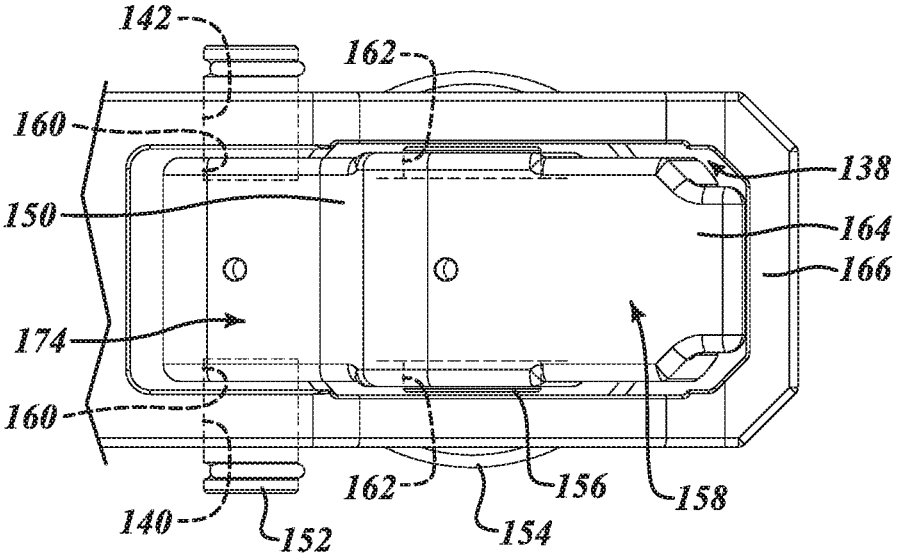
FIG. 7 is a plan view of a portion of the valve bridge assembly shown in FIG. 6.

With additional reference to FIGS. 6 and 7, in one exemplary implementation, the valve bridge assembly 32 comprises the lever assembly 130 disposed within a main bridge main body 132. The bridge main body 132 includes a first end 134 and a second end 136. The first end 134 can be configured to engage valve 28, and the second end 136 can include a first aperture 138, a second aperture 140, and a third aperture 142.

Figure 5:
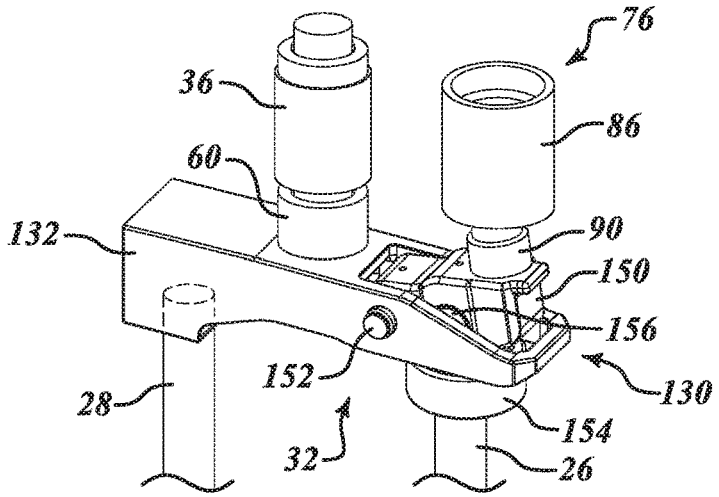
FIG. 5 is a perspective view of a portion of the rocker arm assembly shown in FIG. 1.

As shown in FIG. 5, the lever assembly 130 can generally include a lever 150, a bridge pin 152, a valve shoe 154, and a valve shoe pin 156. The lever 150 can be disposed within the first aperture 138 and is rotatably coupled to the bridge main body 132 by the bridge pin 152, which extends through the second and third apertures 140, 142 of the bridge main body 132.

The lever 150 includes an engagement surface 158, first opposed openings 160, second opposed openings 162, and a stop flange 164. The engagement surface 158 is configured to be selectively engaged by socket 90 of piston assembly 76. First opposed openings 160 can receive the bridge pin 152, and the second opposed openings 162 can receive the valve shoe pin 156. The stop flange 164 can be configured to engage a bar 166 (FIGS. 6 and 7) of the bridge main 132 to limit downward movement of the lever 150 (as shown in FIG. 6).

The valve shoe 154 includes a main body portion 168 and a connecting portion 170 having an aperture 172 formed therein. The main body portion 168 is configured to receive a portion of the valve 26, and the connecting portion 170 is at least partially disposed within lever 150 such that the connecting portion aperture 172 receives the valve shoe pin 156 to rotatably couple the valve shoe 154 to the lever 150.

Accordingly, lever 150 can be selectively engaged at the engagement surface 158, which can cause rotation about pin 156 and upward movement of an opposed side 174 of the lever that is opposite surface 158 (see FIG. 9). This upward movement of lever end 174 causes upward movement of bridge main body 132 toward HLA assembly 36 to prevent extension thereof.

As such, during operation of rocker arm assembly 20, the exhaust rocker arm assembly 16 can selectively engage the valve bridge main body 132 to actuate valves 26, 28 and perform a normal exhaust event (combustion mode); whereas, the engine brake rocker arm assembly 18 can selectively engage the lever assembly 130 to only actuate valve 26 and perform a brake event actuation (engine braking mode).

The piston assembly 76 is configured to move the first piston body 86 between the retracted position and the extended position. In the retracted position, the first piston body 86 is withdrawn into the bore 80 such that the socket 90 is spaced apart from and does not contact the lever engagement surface 158 even when the cam lobe 84 of camshaft 24 engages the engine brake rocker arm 70.

However, in the extended position, the first piston body 86 extends from the bore 80 such that socket 90 is positioned to engage the lever engagement surface 158. When the cam lobe 84 of camshaft 24 engages the engine brake rocker arm 70, socket 90 rotates the lever about pin 156 to engage the valve 26 and perform the brake event actuation. FIG. 4 shows engine brake rocker arm assembly 18 with piston assembly 76 in the extended position as a result of oil being supplied from rocker shaft 22 through channel 100. In this position, engine brake event actuation is active, and piston assembly 76 is configured to engage the lever assembly 130 of the valve bridge assembly 32 (FIG. 9). The engine brake event actuation capability may be deactivated by ceasing the oil supply through channel 100 and/or 118, thereby causing the piston assembly 76 to move to the retracted position.

With reference now to FIGS. 4, 8 and 9, an exemplary operating sequence of the exhaust valve rocker arm assembly 16 and the engine brake rocker arm assembly 18 will be described.

FIG. 8 shows portions of assemblies 16, 18 during a normal exhaust event actuation where the exhaust rocker arm 30 is engaged by cam lobe 50 of cam shaft 24. In particular, as cam shaft 24 rotates, cam lobe 50 engages roller 44, which causes the exhaust rocker arm 30 to rotate about the rocker shaft 22. In this motion, the exhaust rocker arm 30 pushes through the HLA assembly 36 and moves the valve bridge main body 132 downward to open the first and second exhaust valves 26, 28.

FIG. 9 illustrates portions of assemblies 16, 18 during a brake event actuation where the engine brake rocker arm 70 is engaged by the cam lobe 84 of cam shaft 24. In particular, as cam shaft 24 rotates, cam lobe 84 engages roller 74, which causes the brake rocker arm 70 to rotate about the rocker shaft 22. When the first piston body 86 is in the extended position, the brake rocker arm 70 pushes socket 90 downward to engage and cause downward movement of lever engagement surface 158. This in turn can cause downward movement of the valve shoe 154, which opens valve 26 to brake the engine. Further, as lever 150 pivots about pin 156, lever end 174 moves upward against bridge main body 132, which pushes against the HLA assembly 36 to prevent extension thereof during the brake event.

Figure 10:
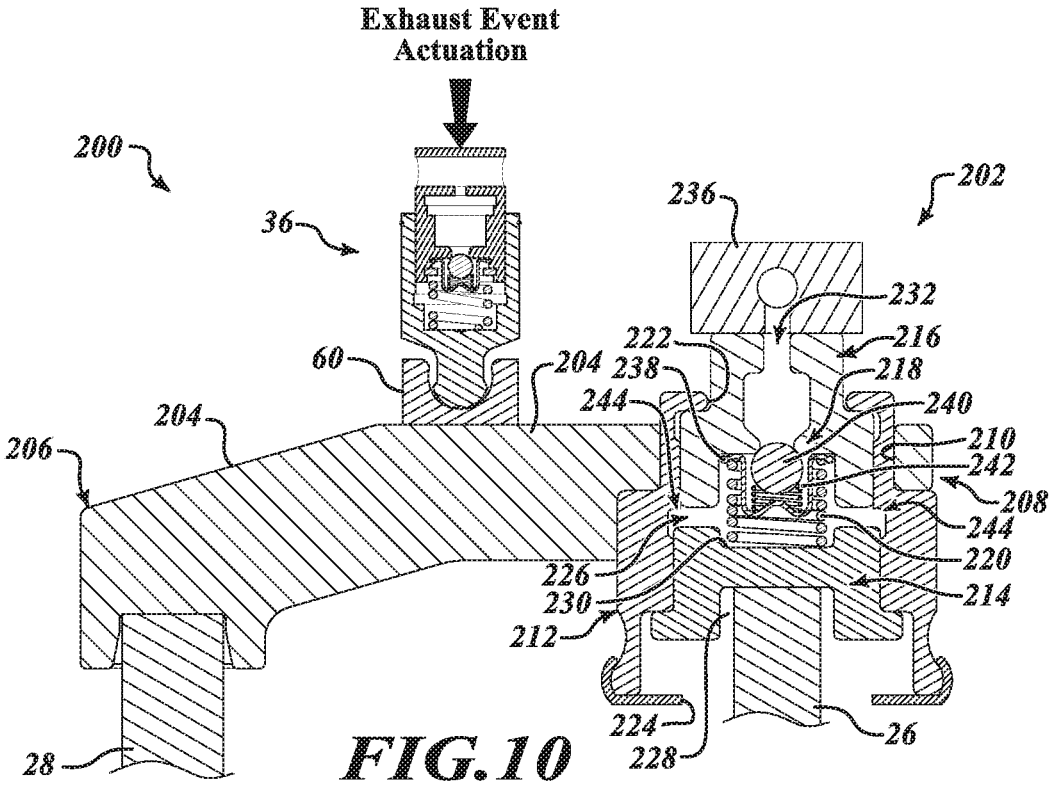
FIG. 10 is a cross-sectional view of another exhaust rocker arm assembly during a normal exhaust event actuation that may be used with the rocker arm assembly shown in FIG. 1, and constructed in accordance to one example of the present disclosure.
Figure 11:
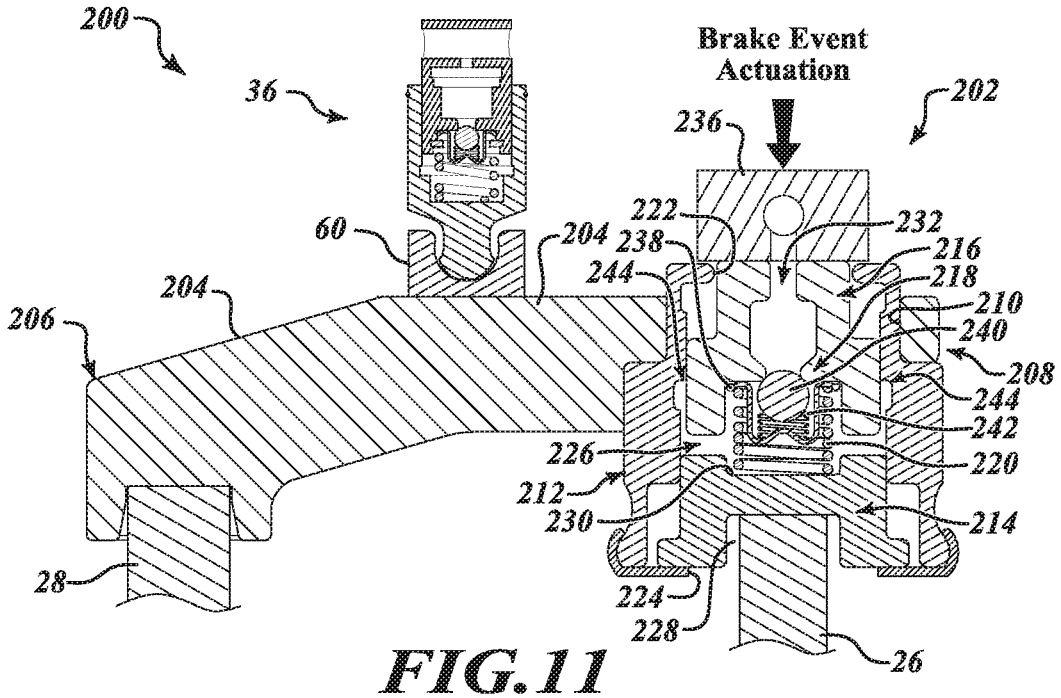
FIG. 11 is a cross-sectional view of the exhaust rocker arm assembly shown in FIG. 10 during a brake event actuation.

FIGS. 10 and 11 illustrate a valve bridge assembly 200 constructed in accordance to one example of the present disclosure. The valve bridge assembly 200 may be utilized with valve train assembly 10 and may be similar to valve bridge assembly 32 except that it can include a hydraulic actuator assembly 202 instead of the lever assembly 130. Accordingly, the valve bridge assembly 200 comprises the hydraulic actuator assembly 202 and a valve bridge main body 204, which includes a first end 206 and a second end 208. The first end 206 can be configured to engage valve 28, and the second end 208 can include an aperture 210.

The hydraulic actuator assembly 202 can be at least partially disposed within aperture 210 and can generally include a capsule or outer housing 212, a first actuator or piston body 214, a second actuator or piston body 216, a check ball assembly 218, and a biasing mechanism 220.

The outer housing 212 defines an upper aperture 222, a lower aperture 224, and a central chamber 226. At least a portion of the second piston body 216 extends through the upper aperture 222, and the lower aperture 224 is configured to receive at least a portion of the exhaust valve 26. The central chamber 226 defines a space between the first and second piston bodies 214, 216 that is configured to receive oil or other fluid from the brake rocker arm 70.

The first piston body 214 can be disposed within the outer housing 212 and can include a valve receiving slot 228 and a seat 230. The valve receiving slot 228 is configured to receive an end of the exhaust valve 26, and seat 230 can be configured for seating at least a portion of the biasing mechanism 220.

The second piston body 216 can be disposed at least partially within the outer housing 212 and can include an oil supply channel 232 and a check ball assembly seat 234. The oil supply channel 232 is fluidly connected to a capsule 236, which is coupled to the brake rocker arm 70 and configured to selectively receive a pressurized oil supply form the channel 118 of rocker shaft 22.

The check ball assembly 218 can be disposed at least partially within the check ball seat 234. The check ball assembly 218 can generally include a retainer 238, a check ball 240, and a biasing mechanism 242. The retainer 238 can be seated within seat 234 and is configured to maintain check ball 240 therein. The biasing mechanism 242 can bias the check ball against seat 234 to seal oil supply channel 232. As such, check ball assembly 218 is in the normally closed position. However, assembly 18 may be configured to have a normally open position.

The biasing mechanism 220 can have a first end seated in the seat 230 of the first piston 214, and a second end seated in the seat 234 of the second piston 216. The biasing mechanism 220 can be configured to bias the first and second pistons 214, 216 apart from each other, and can secure check ball assembly retainer 238 within seat 234. The biasing apart of first and second pistons 214, 216 can act to draw oil from channel 232 into central chamber 226 to assure oil is stored therein.

FIG. 10 shows portions of assemblies 16, 18 during a normal exhaust event actuation where the exhaust rocker arm 30 is engaged by cam lobe 50 of cam shaft 24 (see FIG. 2). In particular, as cam shaft 24 rotates, cam lobe 50 engages roller 44, which causes the exhaust rocker arm 30 to rotate about the rocker shaft 22. In this motion, the exhaust rocker arm 30 pushes through the HLA assembly 36 and moves the bridge main body 204 downward to open the first and second exhaust valves 26, 28.

FIG. 11 illustrates portions of assemblies 16, 18 during a brake event actuation where the engine brake rocker arm 70 is engaged by the cam lobe 84 of cam shaft 24 (see FIG. 2). In particular, as cam shaft 24 rotates, cam lobe 84 engages roller 74, which causes the brake rocker arm 70 to rotate about the rocker shaft 22. Pressurized oil is supplied through capsule 236 to oil supply chamber 232. The pressurized fluid and/or biasing mechanism 220 opens check ball assembly 218 such that oil fills the central chamber 226.

When the brake rocker arm 70 is engaged by the cam lobe 84, the rocker arm 70 can push capsule 236 downward to engage the second piston body 216, causing downward movement thereof. This downward movement of piston body 216 can force the fluid in central chamber 226 against the top of first piston body 214, causing downward movement thereof. This can force valve 26 downward to open and brake the engine. Additionally, the downward movement of piston body 216 can force the fluid in the central chamber 226 upward against an inner rim 244 of the outer housing 212. This causes upward movement of the outer housing 212, which provides enough upward force to the valve bridge main body 204 to prevent extension of the HLA assembly 36 during the brake event actuation.

Described herein are systems and methods for braking an engine. The system includes an exhaust valve rocker arm that engages a valve bridge to actuate two valves to perform an exhaust event. In one aspect, the valve bridge includes a main body and a lever integrated therein, the internal lever being rotatable relative to a valve bridge main. The rotatable lever can be selectively engaged and rotated by an engine brake rocker arm to actuate one of the two valves to perform an engine brake event.

Moreover, the lever can simultaneously pass some of the valve actuation force back to the HLA assembly, thereby preventing unintended extension of the HLA assembly during the braking event. Thus, the internal lever allows the valve to open during the engine braking operation without cocking or rotating the main body, which can cause the unintended extension. Additionally, lever assembly significantly reduces the actuation force required for the braking event compared to known systems. In another aspect, the valve bridge can include a hydraulic actuator assembly, which utilizes a hydraulic intensifier to multiply load (reduce stroke), while transferring some of the load to the bridge and the HLA.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An exhaust valve rocker arm assembly selectively opening first and second exhaust valves and comprising:

an exhaust rocker arm;

an engagement capsule;

an engine brake rocker arm, wherein the engagement capsule is coupled to the engine brake rocker arm;

a valve bridge operably associated with the rocker arm and including a main body; and a hydraulic actuator assembly disposed at least partially within an aperture formed within the main body, the hydraulic actuator assembly including a first piston body and a second piston body disposed at least partially within the aperture formed in the main body;

wherein the exhaust rocker arm is configured to engage the valve bridge main body to engage the first exhaust valve, and the engagement capsule is configured to engage the hydraulic actuator assembly to engage the second exhaust valve.

2. The exhaust valve rocker arm assembly of claim 1, wherein the hydraulic actuator assembly further includes an outer housing, the first piston body and the second piston body at least partially disposed within the outer housing and defining a central chamber therebetween configured to receive a fluid.

3. The exhaust valve rocker arm assembly of claim 1, wherein the hydraulic actuator assembly further comprises a biasing mechanism disposed between the first piston body and the second piston body.

4. The exhaust valve rocker arm assembly of claim 1, wherein the engagement capsule is fluidly coupled to an oil supply channel formed in the second piston body.

5. The exhaust valve rocker arm assembly of claim 4, wherein the second piston body includes a check ball assembly seat receiving a check ball assembly.

6. The exhaust valve rocker arm assembly of claim 5, wherein the check ball assembly comprises a retainer, a check ball, and a biasing mechanism.

7. The exhaust valve rocker arm assembly of claim 1, further comprising a hydraulic lash adjuster assembly coupled between the exhaust rocker arm and the valve bridge.

8. An exhaust valve rocker arm assembly selectively opening first and second exhaust valves and comprising:

an exhaust rocker arm;

an engagement capsule;

a valve bridge operably associated with the rocker arm and including a main body; and a hydraulic actuator assembly disposed at least partially within an aperture formed within the main body, the hydraulic actuator assembly including a first piston body and a second piston body disposed at least partially within the aperture formed in the main body;

wherein the exhaust rocker arm is configured to engage the valve bridge main body to engage the first exhaust valve, and the engagement capsule is configured to engage the hydraulic actuator assembly to engage the second exhaust valve, wherein the engagement capsule is fluidly coupled to a pressurized oil supply.

9. The exhaust valve rocker arm assembly of claim 8, wherein the hydraulic actuator assembly further includes an outer housing, the first piston body and the second piston body at least partially disposed within the outer housing and defining a central chamber therebetween configured to receive a fluid.

10. The exhaust valve rocker arm assembly of claim 8, wherein the hydraulic actuator assembly further comprises a biasing mechanism disposed between the first piston body and the second piston body.

11. The exhaust valve rocker arm assembly of claim 8, further comprising an engine brake rocker arm, wherein the engagement capsule is coupled to the engine brake rocker arm.

12. The exhaust valve rocker arm assembly of claim 8, wherein the engagement capsule is fluidly coupled to an oil supply channel formed in the second piston body.

13. The exhaust valve rocker arm assembly of claim 12, wherein the second piston body includes a check ball assembly seat receiving a check ball assembly.

14. The exhaust valve rocker arm assembly of claim 13, wherein the check ball assembly comprises a retainer, a check ball, and a biasing mechanism.

15. The exhaust valve rocker arm assembly of claim 8, further comprising a hydraulic lash adjuster assembly coupled between the exhaust rocker arm and the valve bridge.

16. An exhaust valve rocker arm assembly selectively opening first and second exhaust valves and comprising:

an exhaust rocker arm;

a valve bridge operably associated with the rocker arm and including a main body and a movable lever assembly integrated into the main body, the main body configured to engage the first exhaust valve, and the lever assembly configured to engage the second exhaust valve; and a hydraulic lash adjuster (HLA) assembly coupled between the exhaust rocker arm and the valve bridge, wherein the lever assembly is configured to pass a portion of a valve actuation force back to the HLA assembly to facilitate preventing unintended extension of the HLA assembly during a braking event.

* * * * *